US007530445B2

(12) United States Patent
Marshall et al.

(10) Patent No.: US 7,530,445 B2
(45) Date of Patent: May 12, 2009

(54) LONG STROKE SLIDE ASSEMBLIES

(75) Inventors: Harold James Marshall, Forest, VA (US); Jeffrey L. Shortridge, Lynchburg, VA (US)

(73) Assignee: Belvac Production Machinery, Inc., Lynchburg, VA (US)

( * ) Notice: Subject to any disclaimer, the term of this patent is extended or adjusted under 35 U.S.C. 154(b) by 171 days.

(21) Appl. No.: 11/643,950

(22) Filed: Dec. 22, 2006

(65) Prior Publication Data

US 2007/0227859 A1 Oct. 4, 2007

Related U.S. Application Data

(60) Provisional application No. 60/787,502, filed on Mar. 31, 2006.

(51) Int. Cl.
*B65G 47/04* (2006.01)

(52) U.S. Cl. ..... 198/476.1; 198/474.1; 198/483.1

(58) Field of Classification Search ..... 198/470.1, 198/474.1, 476.1, 477.1, 482.1, 483.1
See application file for complete search history.

(56) References Cited

U.S. PATENT DOCUMENTS

| | | | | |
|---|---|---|---|---|
| 1,621,301 | A * | 3/1927 | Wright | 198/476.1 |
| 2,686,551 | A | 8/1954 | Laxo | |
| 2,928,454 | A | 3/1960 | Laxo | |
| 3,096,709 | A * | 7/1963 | Eldred et al. | 198/476.1 |
| 4,892,184 | A * | 1/1990 | vander Griendt et al. | 198/476.1 |
| 6,199,420 | B1 | 3/2001 | Bartosch | |
| 6,779,651 | B1 * | 8/2004 | Linglet et al. | 198/474.1 |
| 2005/0193796 | A1 | 9/2005 | Heiberger et al. | |

FOREIGN PATENT DOCUMENTS

| | | |
|---|---|---|
| DE | 1 939 623 | 2/1970 |
| DE | 101 56 085 | 5/2003 |
| JP | 2003-237752 | 8/2003 |
| JP | 2003-252321 | 9/2003 |
| JP | 2004-002557 | 1/2004 |
| JP | 2004-130386 | 4/2004 |
| JP | 2004-217305 | 8/2004 |
| JP | 2005/022663 | 1/2005 |
| WO | WO-96/33032 | 10/1996 |
| WO | WO-97/37786 | 10/1997 |

OTHER PUBLICATIONS

U.S. Appl. No. 11/581,787, filed Oct. 17, 2006, Marshall.
U.S. Appl. No. 11/643,934, filed Dec. 22, 2006, Shortridge.
U.S. Appl. No. 11/643,935, filed Dec. 22, 2006, Shortridge et al.

(Continued)

*Primary Examiner*—James R Bidwell
(74) *Attorney, Agent, or Firm*—Foley & Larnder LLP

(57) ABSTRACT

A slide assembly for use on a forming turret in a machine line that forms articles, such as cans, comprises a fixed rail, a slide block configured to slide in the rail, and an adaptor that is mounted to the rail. The slide assembly is configured to provide at least a 4.0 inch or more stroke that is stable and minimizes shaking or other movement. The slide assembly is designed such that ends of at least one of the adaptor and rail remain rigid during the stroke operation.

20 Claims, 5 Drawing Sheets

OTHER PUBLICATIONS

U.S. Appl. No. 11/692,564, filed Mar. 28, 2007, Marshall et al.
U.S. Appl. No. 11/692,584, filed Mar. 28, 2007, Schill et al.
International Search Report, 2 pages.

Applicant informs the PTO the an offer for sale was made more than one year before the date of this application of a device represented by the attached Figure ("Exhibit A"). Additional information is available upon request.

* cited by examiner

LONG STROKE SLIDE ASSEMBLIES

CROSS-REFERENCE TO RELATED PATENT APPLICATIONS

This application claims the benefit under 35 U.S.C. § 119 (e) of U.S. Provisional Application No. 60/787,502, filed Mar. 31, 2006, which is incorporated herein by reference in its entirety.

BACKGROUND

The present invention relates generally to push ram assemblies. More specifically, this invention relates to push ram assemblies that are capable, in one embodiment, of allowing for a longer stroke while minimizing disturbances or shaking.

Ram assemblies may be used to push or move articles, such as cans. For example, ram assemblies may be used to push a can that is being processed in a curling, cutting, expanding, neck, or other forming operation machine.

Conventional ram assemblies comprise a cylindrical or round ram, which moves axially relative to the turret shaft, and a plain bushing, which is mounted fixed to the shaft. The ram can be moved by a ribbed barrel cam. However, such conventional rams can have limitations at longer strokes. For example, one such limitation is due to the pressure angle of the cam. At longer strokes, the pressure angle increases. This higher pressure angle puts a higher side load on the ram and bushing, which can cause the ram to bind in the bushing. Another downfall of conventional ram assemblies is that a can or other article being pushed by the ram assembly may enter a forming die at an incorrect angle, which can cause defects in the can. In a long stroke application, conventional ram assemblies require a larger clearance between the ram and the bushing. The clearance allows the end of the ram, which controls the position of the can, to move. This larger clearance may cause the can to enter the forming die at an angle causing defects in the can.

SUMMARY

One embodiment of the invention relates to a processing turret. The processing turret comprises: a processing element to process an article; a cam; a cam support; and a slide assembly for moving an article and/or the processing element in the processing turret, the slide assembly including a rail and an adaptor. The assembly is configured to provide approximately a 2.6 inch stroke or more to move the article and/or processing element and ends of at least one of the adaptor and rail remain rigid during the stroke operation.

Another embodiment of the invention relates to a machine line for processing an article. The machine line comprises: at least one forming turret for processing an article; and a slide assembly to move the article and/or a processing element on the forming turret. The slide assembly comprises: a fixed rail; a slide block configured to slide in the rail; and an adaptor mounted to the rail. The assembly is configured to provide at least an approximately 4.0 inch or more stroke while moving the article and/or the processing element.

Yet another embodiment of the invention relates to an apparatus for a slide assembly. The apparatus comprises: a rail; and an adaptor mounted to the rail. The assembly is configured to provide at least an approximately 4.0 inch or more stroke to move a can in a can processing machine, and ends of at least one of the adaptor and rail remain rigid during the stroke operation.

Another embodiment of the invention relates to a method for a utilizing a ram assembly in an article forming apparatus. The method comprises the steps of: performing a forming operation on the article in a forming head; and performing at least an approximately 4.0 inch or more stroke with the ram assembly while maintaining proper alignment of the article with the forming head.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION

Figure 1:
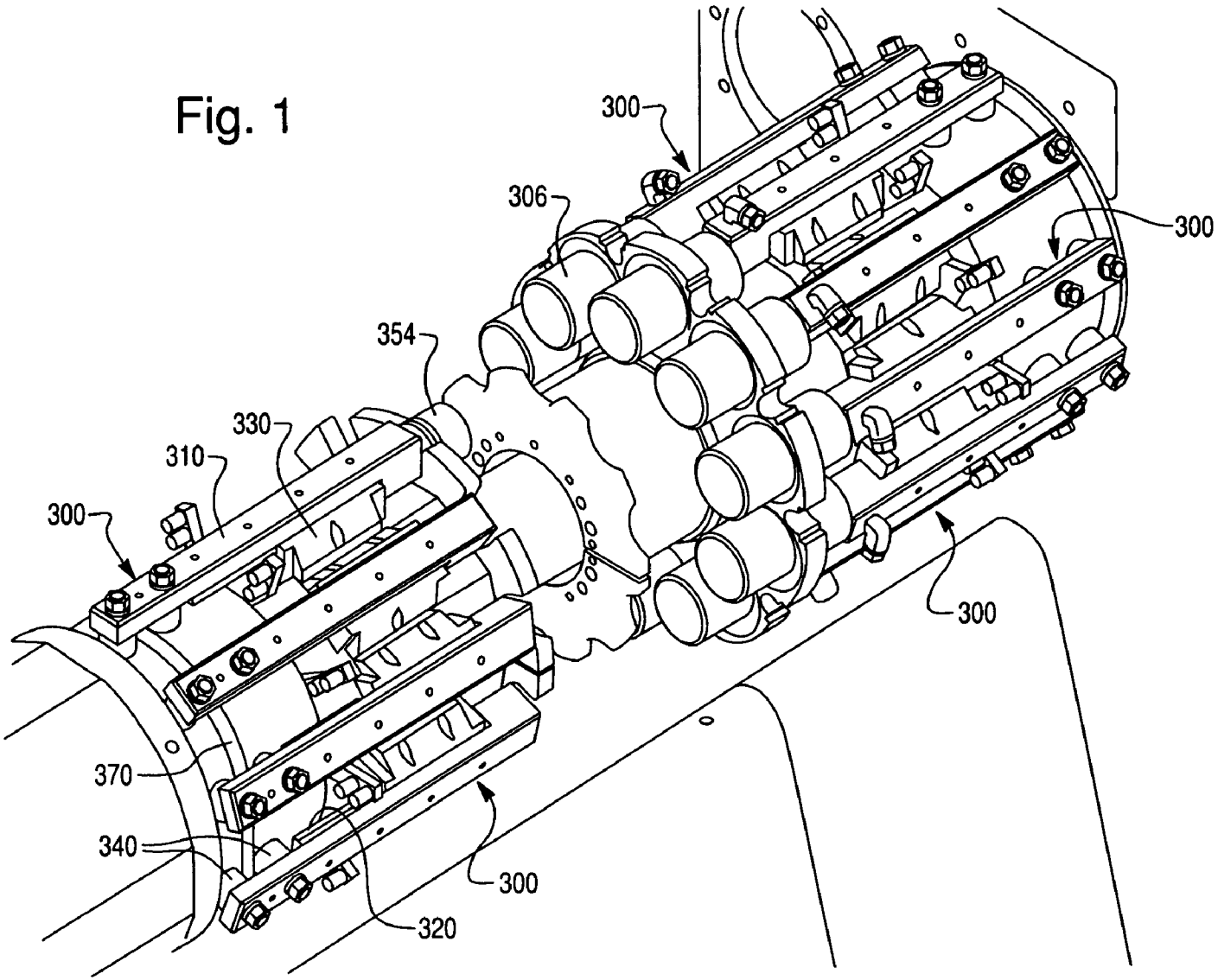
FIG. 1 is perspective view of a plurality of long stroke ram assemblies installed on a shaft according to an embodiment of the invention in which both push rams and knock-out rams are shown.

According to one aspect of the invention, a linear slide mechanism has been created to use in place of (or in addition to) the standard cylindrical ram assembly.

An embodiment of the invention relates to an apparatus comprising a slide assembly with a rail and an adaptor. The assembly is configured to have at least a four inch stroke and that the ends of the adaptor and/or rail remain rigid during the stroke.

An embodiment of the invention relates to a slide assembly comprising a rail, a slide block configured to slide in the rail and an adaptor mounted to the rail. The rail is fixed. One end of the adaptor includes a cam follower and an opposite end of the adaptor includes a mounting device. The mounting device may be a knockout-tooling device (such as a trimmer, curler, can expander, threader, or any other suitable tooling) or a push plate device to push a can into or towards a tooling device.

Machines may be used to form, process or otherwise perform an action on an article. In a machine line, an article is first fed into a first machine to fill stations in a turret/star wheel. Each star wheel may have any number of stations to hold articles for processing or transfer. For example, a star wheel may have six, eight or ten stations to hold six, eight or ten articles, respectively. It will be recognized that the star wheel is capable of having one station up to any suitable number of stations. The articles may be moved (pushed) by a ram assembly to move the articles into the correct processing apparatus, such as a forming die, cutting stage, expansion machine, etc.

The article is then processed through any number of stages, one or more of which may be a diameter expansion stage, a necking stage, a curling stage, or any other suitable process or forming stage. In any, and sometimes all of these stages, a push ram assembly is used to move the article into its proper location for processing. When all process/forming stages are complete, the article is discharged from the machine. The machine line may be a recirculated machine line or any other type of machine line.

Embodiments of the invention will now described with reference to the figures.

FIGS. 1-9 illustrate a ram assembly apparatus 300 for moving an article 305 through a machine line 102. An article 305 may be a can, any suitable food or beverage container, jar, bottle or any other suitable article. The article 305 has an open end, opposite a closed end and a sidewall extending from the closed end. Alternatively, the article 305 may be open at both ends, or the article 305 may comprise any other desired configuration. A top, lid or other closure can be added to the article 305 after an expansion process.

For exemplary purposes only, the below description will describe the ram assembly 300, which may be used in a machine (such as a necking machine), machines or a machine line for use in processing a can 305. It will be recognized that any other type of article 305 (such as that described above) may be used. Furthermore, it will be recognized that any other type of machine may utilize a slide assembly, such as, for example, a machine for necking a can, a machine for moving a can from one processing stage to another, a machine for adding a lid. Alternatively, a slide assembly may be utilized on a machine that does not operate on cans, but may be used on machines that work on any other suitable machine or assembly line.

Figure 2:
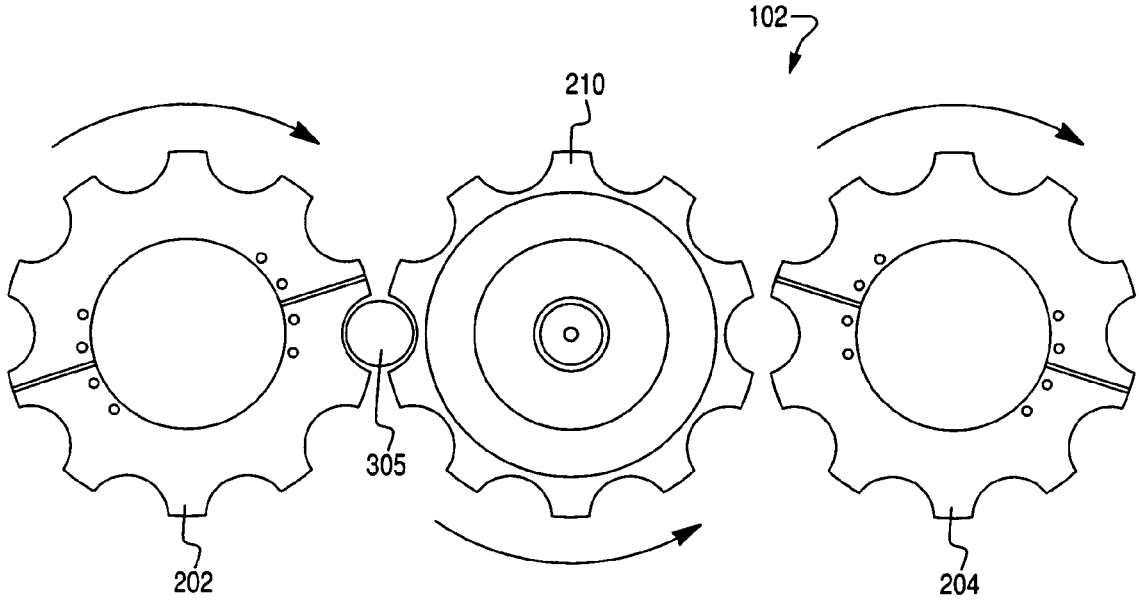
FIG. 2 is a schematic of a machine line with a can forming machine that utilizes a ram assembly according to an embodiment showing an infeed turret, a forming/process turret and a discharge or secondary turret.

FIGS. 1 to 9 illustrate a machine line in which cans 305, according to an embodiment, are fed into a continuously rotating turret 210 (FIG. 2) either from an infeed track or from a preceding process turret 202. FIG. 1 is an exemplary view of a plurality of ram assemblies 300 installed on a shaft in a machine, such as an expansion machine. FIG. 2 illustrates an infeed turret star wheel 202 passing a can 305 to the continuously rotating turret star wheel 210 of the can expansion process. While the turret 210 is rotating with the can 305 loaded into a forming station therein, a forming tooling (not shown) may be applied to the can 305 to perform a forming operation on the can 305. The forming tooling is then withdrawn. The can 305 is then transferred from the forming turret 210 onto another process turret 204 or a discharge track, in the direction illustrated by the arrows in FIG. 2.

The apparatus 300 can be installed on a shaft of a machine in a machine line 102 that, according to an embodiment, comprises an infeed vacuum transfer wheel 202, the forming turret 210, and a discharge vacuum transfer wheel 204. Both the infeed and discharge vacuum transfer wheels 202, 204 are similar in design and function. The infeed wheel 202 loads the can 305 into the forming turret 210 and the discharge wheel 204 unloads the can 305 from the forming turret 210.

The cans 305, in one embodiment, are held in position on this first transfer star wheel 202 (and other star wheels or turrets) using a pneumatic pressure differential or "suction" as it will be referred to.

The cans 305 are then passed from the first transfer star wheel 202 to a first turret star wheel 210 and enter into the can forming process on the forming machine with the ram assembly 300. While the invention is not so limited, embodiments of the invention may comprise forming machines with one or more ram assemblies 300 constructed as modules. The use of modules allows for the machine line 102 to be assembled/changed to provide as many forming stages as is required and to allow for adding additional stages such as flanging, necking, trimming, curling, threading, and/or base reforming/reprofiling stages, which may added and/or removed as desired.

In an embodiment, each of the turret star wheels 202, 210, 204 may be composed of two segments, which are connected to a drive shaft by way of a timing plate. These timing plates are individually adjustable with respect to the respective turret drive shaft in a manner which allows their angular rotational position with respect to the turret drive shaft to be adjusted and then fixed to the degree that the two segments of the turret star wheel which are mounted thereon, are positioned/timed with respect to the transfer star wheels on either side thereof, so that a smooth, continuous, incident-free transfer of cans 305 between the turret star wheels and the respective transfer star wheels, can take place.

As noted above, in one embodiment, the transfer star wheels are arranged to hold the cans 305 in position using suction. The star wheels may have a vacuum port formed in a channel portion(s) that are fluidly communicating with a source of vacuum (negative pneumatic pressure) via a suitable manifold. The vacuum is delivered to the vacuum ports, and the surface area of the cans which are exposed to the suction is increased to a degree that the cans are stably held in position as each can passes below the transfer star wheel axis of rotation.

Necking machines for metal cans 305 utilize ram assemblies 300 for pushing the can 305 into a tooling 306 (such as a forming die 306) and for moving the necking machine as appropriate. For example, a ram assembly 300 may include a push pad or plate 354 to move a can 305. Alternatively, the ram assembly 300 may include tooling 306 attached at an end of the assembly 300. Ram assemblies 300 may also be used in other applications and for other types of machines.

The linear slide assembly 300, such as shown in FIGS. 3-6, comprises a slide block 330 containing rolling elements (such as ball bearings, not shown) and a profiled rail 320. The profiled rail 320 is configured to slide in the slide block 330. Conventionally, the profiled rail is the fixed component with the slide block being the component that moves. According to this embodiment of the invention, the mountings are inverted such that the slide block 330 is fixed and the profiled rail 320 is capable of moving. This mounting may offer a more compact design for the entire ram assembly 300 while maintaining the load at the center of the rolling elements in the slide block 330. By keeping the load at the center of the rolling elements, the load applied on the ram assembly is reduced. The mounting may also reduce the mass of the moving components.

The ram assembly 300 is designed to be more rigid than conventional assemblies due to the configuration of a stable (non-moving) slide block 330 that is located on the base (i.e., bottom) of the assembly 300. The profiled rail 320 slides over the slide block 330. The ram assembly 300 is rigid because the rolling elements between the slide block 330 and profiled rail 320 allow the ram assembly 300 to be built with zero clearance or a slight preload, which eliminates and "play" (movement) or instability in the ram; thus creating a more rigid ram assembly 300.

The ram assembly 300 is rigid also because the moving profiled rail 320 is smaller than the stable slide block 330. In other words, the immobile base (the slide block 330) is larger than the moving part (the profiled rail 320), which lends to having a ram assembly 300 that is more rigid than conventional ram assemblies.

Figure 3:
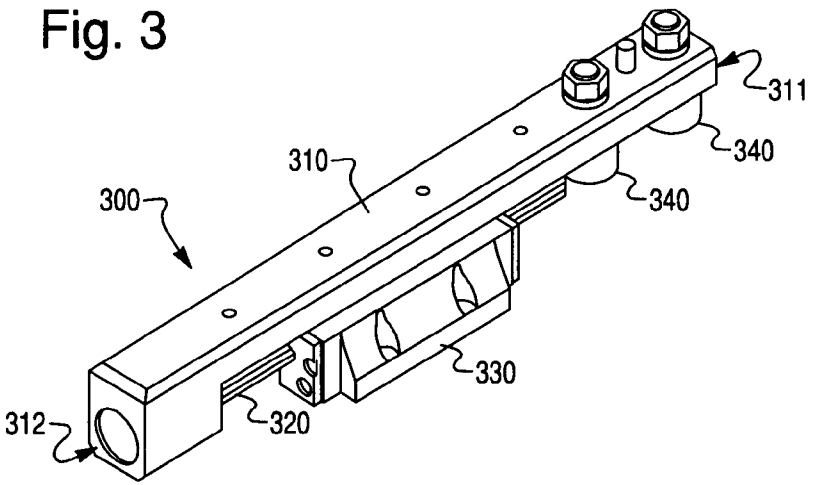
FIG. 3 is a top, perspective view of a push ram assembly.
Figure 4:
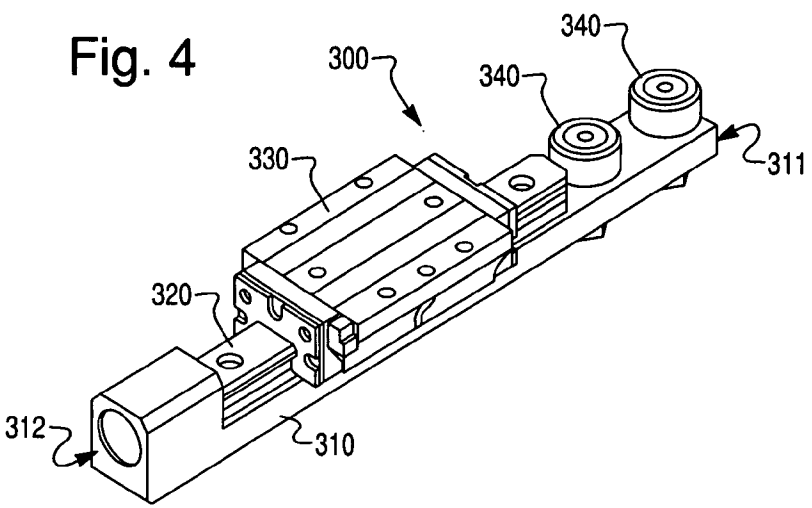
FIG. 4 is a bottom, perspective view of the push ram assembly of FIG. 3.
Figure 5:
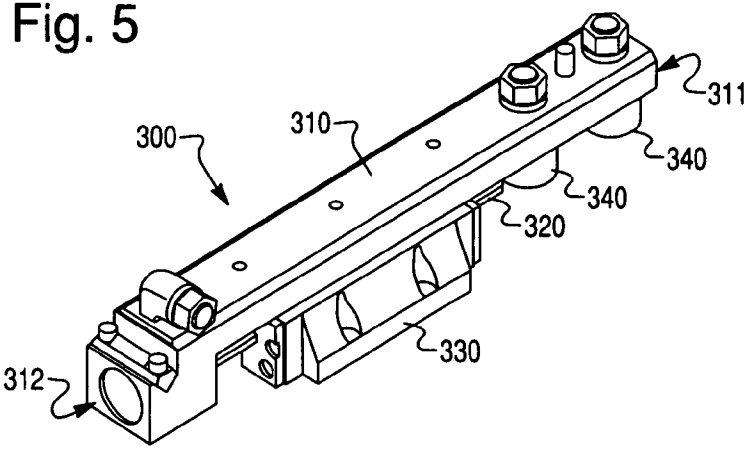
FIG. 5 is a top, perspective view of a knock-out ram assembly.
Figure 6:
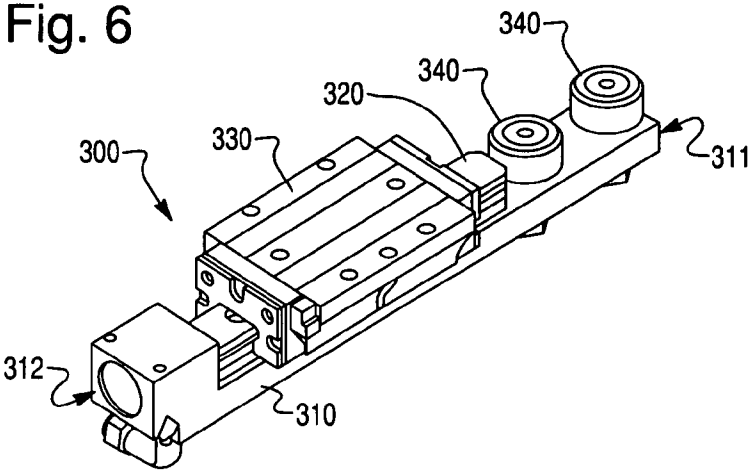
FIG. 6 is a bottom, perspective view of the knock-out ram assembly of FIG. 5.

In addition to the slide block 330 and profiled rail 320, the assembly 300 includes an adaptor 310 mounted to the profiled rail 320. On one end 311 of the adaptor 310 there are provisions for mounting cam followers 340. On the other end 312 of the adaptor 310 there are provisions for mounting either a push plate device (such as a pad) 354 (as shown in FIG. 1) or a tooling component 306 (such as shown in FIG. 1). FIGS. 3 and 4 illustrate a ram assembly 300 prior to assembly with a push plate device 354. FIGS. 5 and 6 illustrate a ram assembly 300 prior to assembly with a tooling 306. The tooling 306 may be can necking, can expansion, or any other suitable tooling.

The rail is "profiled" due to its shape. The rail 320 has been cut or formed into the outline (profile) shown in FIGS. 3-6 and, thus, is a profiled rail. Alternatively, the rail 320 may be cut or formed into any other suitable shape (profile). For example, the rail 320 may be formed to have a rectangular shape with grooves or ridges, such as shown in FIG. 6. Alternatively, the rail 320 may have a profiled shape that comprises a single rounded profile, or a combination of rounded curves and angular or flat portions.

Figure 7:
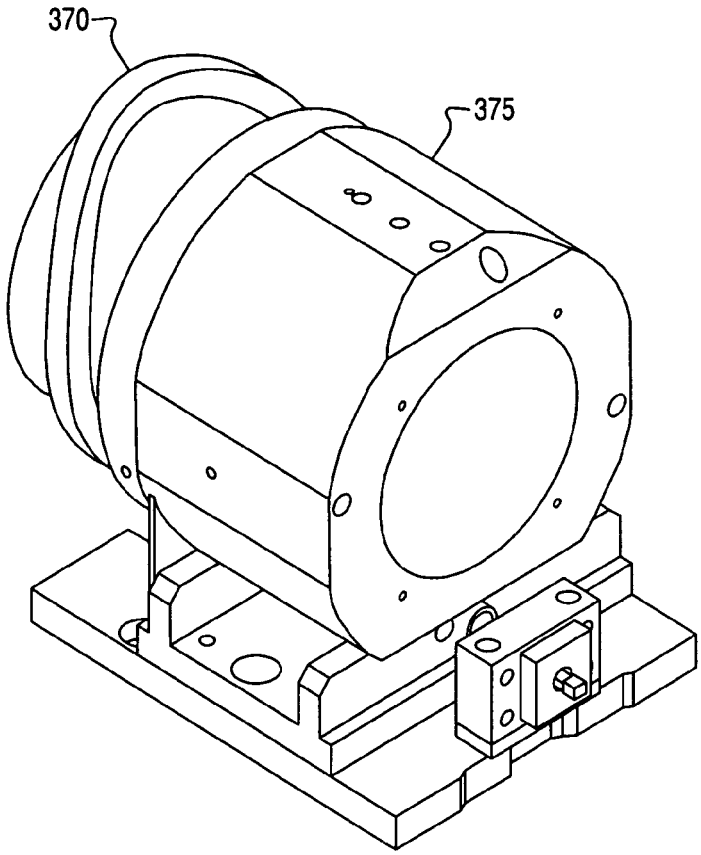
FIG. 7 is a perspective view showing a cam support and a cam on which ram assembly may be utilized.

The ram assembly 300 may be moved by following a ribbed barrel cam, such as the cam 370 shown in FIG. 7. Cam followers 340 on the ram assembly 300 follow a cam 370 positioned on a cam support 375 on a shaft. The structure of the assembly 300 allows for approximately a 2.6 inch (approximately 6.6 cm) or more stroke while maintaining a rigid (inflexible) support at the end 312 of the adaptor and/or profiled rail 320. Alternatively, the ram assembly 300 may have approximately a 4.0 inch (approximately 10.16) or more stroke while maintaining a rigid support. In yet another embodiment, the ram assembly 300 may have approximately a 4.6 inch (approximately 11.68 cm) or more stroke on a can forming machine while maintaining a rigid support.

For example, as the cam followers 340 follow the cam 370, the assembly moves in a forward and backward direction. At the forward most position, the adaptor 310, profiled rail 320 or any other component of the assembly 300 may be sufficiently rigid to prevent a can (or other article) in the push plate device 354 to enter the knockout-tooling component 306 incorrectly aligned such that defects are not formed in the can.

Figure 8:
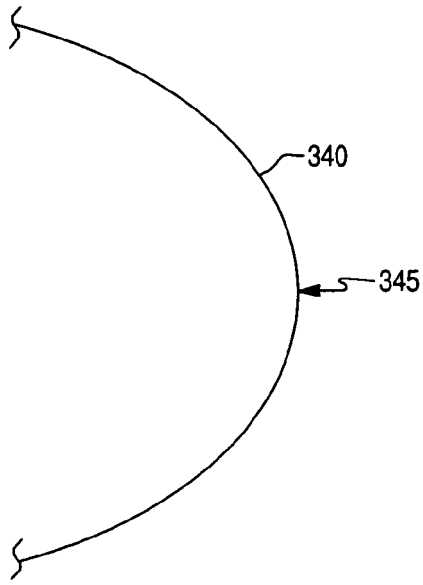
FIG. 8 is a profile view of a cam follower.

The cam followers 340 can have a crowned, flat, or any other suitable profile. FIG. 7 illustrates an example of a cam follower 340 with a crowned profile according to an embodiment of the invention. The cam follower 340 may have the crowned/curved shape in order to prevent off center loading. The outermost position of the crown is located at the center 345 of the cam follower 340 profile and, thus, the contact point for the cam follower 340 to the cam 370 is at the center 345. This arrangement will place the contact point at the center of any forces. It will be recognized that the profile shown in FIG. 8 is exemplary only. The crowned profile of the cam follower 340 may be more or less curved.

The rolling elements, according to an embodiment, may be preloaded ball bearings. The bearings may be auto-lubricated by any suitable mechanism.

Figure 9:
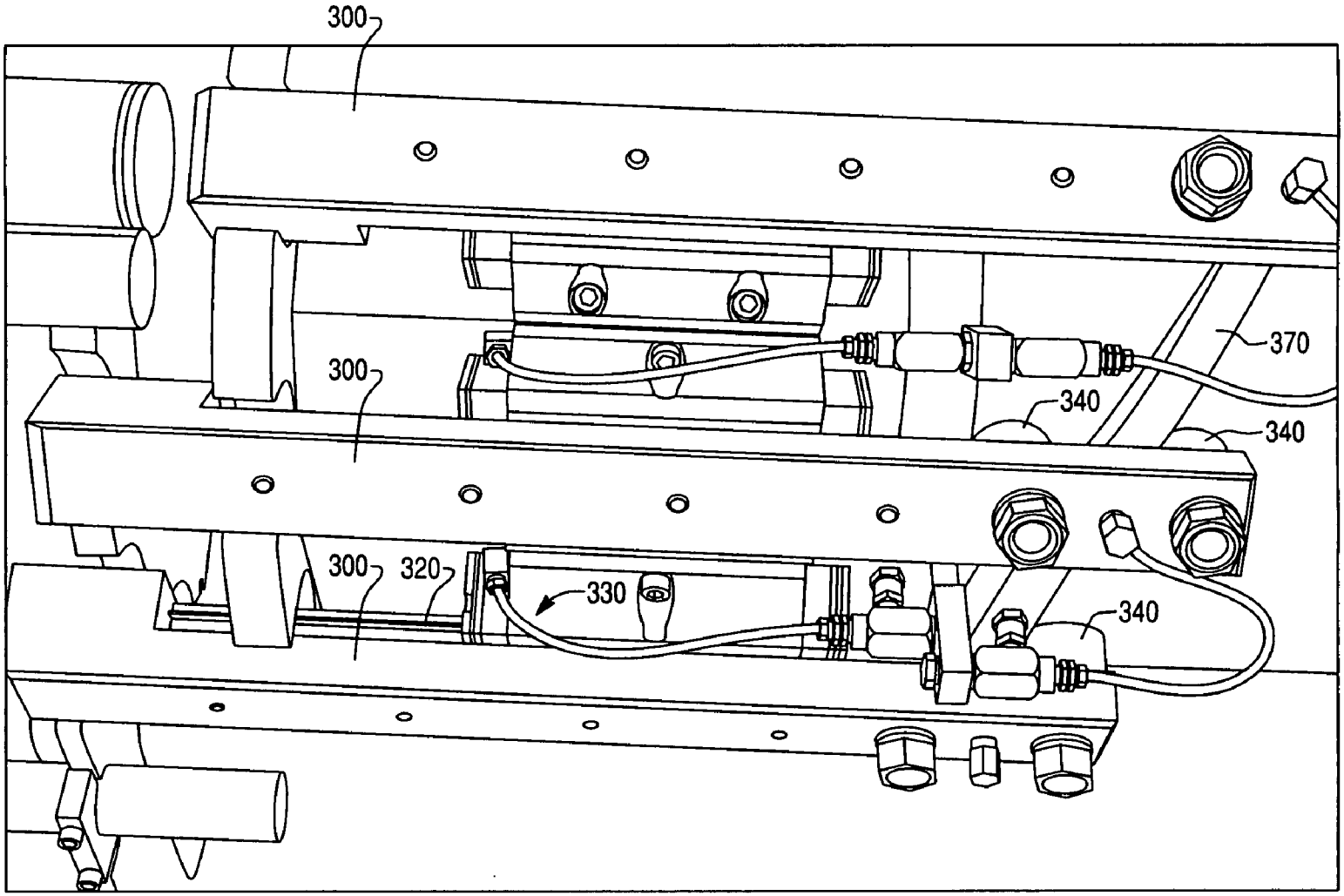
FIG. 9 is a view of a plurality of ram assemblies installed on a shaft.

The ram assemblies 300 may be utilized on a necking machine, or any other suitable type of machine. For example, the ram assemblies may be connected to a turret star wheel to push and hold a can into a tooling die (such as a necking machine), or to control the tooling die. For example, FIG. 9 illustrates a plurality of ram assemblies 300 on a shaft (not shown) of a necking turret.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A processing turret, comprising:

a processing element to process an article;

a cam;

a cam support; and a slide assembly for moving the article and/or the processing element in the processing turret, the slide assembly including a slide block, a rail, and an adaptor, the slide block comprising rolling elements and configured so that during a stroke of the slide assembly, a force imparted onto the slide assembly by the stroke is centered on the rolling elements, wherein the assembly is configured to provide approximately a 4.0 inch stroke or more to move the article and/or processing element, and wherein ends of at least one of the adaptor and rail remain rigid during the stroke operation.

2. The processing turret according to claim 1, wherein one end of the adaptor includes a cam follower to follow the cam, and an opposite end of the adaptor includes a mounting device.

3. The processing turret according to claim 2, wherein the cam follower includes a crowned profile to follow the cam.

4. The processing turret according to claim 1, wherein the rail slides in the slide block.

5. The processing turret according to claim 1, wherein the slide block is fixed.

6. The processing turret according to claim 2, wherein the mounting device includes a knockout-tooling device.

7. The processing turret according to claim 2, wherein the mounting device includes a push-plate.

8. The processing turret according to claim 1, wherein the article is a bottle or can and the processing element is a bottle or can processing element.

9. The processing turret according to claim 1, wherein the assembly provides approximately a 4.6 inch or more stroke.

10. A machine line for processing an article, comprising:

at least one forming turret for processing an article; and a slide assembly to move the article and/or a processing element on the forming turret, the slide assembly comprising:

a fixed rail;

a slide block configured to slide in the rail, the slide block comprising rolling elements and configured so that during a stroke of the slide assembly, a force imparted onto the slide assembly by the stroke is centered on the rolling elements; and an adaptor mounted to the rail.

11. The machine line according to claim 10, wherein one end of the adaptor includes a cam follower, and an opposite end of the adaptor includes a mounting device.

12. The machine line according to claim 10, wherein the cam follower includes a crowned profile to follow the cam.

13. The machine line according to claim 10, wherein the slide block is fixed.

14. The machine line according to claim 11, wherein the mounting device includes a knockout-tooling device.

15. The machine line according to claim 11, wherein the mounting device includes a push-plate.

16. The machine line according to claim 10, wherein the article is a bottle or can and the forming turret is a bottle or can forming turret.

17. The machine line according to claim 10, wherein the assembly provides approximately a 4.6 inch or more stroke.

18. A processing turret, comprising:

a processing element to process an article;

a cam;

a cam support; and a slide assembly for moving the article and/or the processing element in the processing turret, the slide assembly including a slide block, a rail, and an adaptor, wherein ends of at least one of the adaptor and rail remain rigid during the stroke operation, and wherein the slide block is wider than the rail and cam followers.

19. The processing turret according to claim 18, wherein the slide block is fixed to the turret and the slide rail slides on top of the slide block.

20. The processing turret according to claim 18, wherein the slide assembly is configured to provide approximately a 4.0 inch stroke or more to move the article and/or processing element.

* * * * *